US010154744B1

(12) United States Patent
Stuart et al.

(10) Patent No.: US 10,154,744 B1
(45) Date of Patent: Dec. 18, 2018

(54) TIERED FAJITA SERVER

(71) Applicants: Breanne Kinte Stuart, Hartlant, MI (US); Brian Michael Stuart, Hartland, MI (US)

(72) Inventors: Breanne Kinte Stuart, Hartlant, MI (US); Brian Michael Stuart, Hartland, MI (US)

( * ) Notice: Subject to any disclaimer, the term of this patent is extended or adjusted under 35 U.S.C. 154(b) by 0 days.

(21) Appl. No.: 15/924,187

(22) Filed: Mar. 17, 2018

(51) Int. Cl.

| | |
|---|---|
| ***A47G 19/08*** | (2006.01) |
| ***A47G 23/06*** | (2006.01) |
| ***A47F 5/04*** | (2006.01) |
| ***A47B 96/02*** | (2006.01) |

(52) U.S. Cl.
CPC ..... *A47G 19/08* (2013.01); *A47B 96/021* (2013.01); *A47B 96/027* (2013.01); *A47F 5/04* (2013.01); *A47G 23/06* (2013.01)

(58) Field of Classification Search
CPC ..... A47G 19/08; A47G 23/06; A47F 5/04; A47F 5/06; A47B 13/023; A47B 2013/024; A47B 2013/025; A47B 96/02; A47B 96/021; A47B 96/027; A47B 96/028; A47B 47/022
See application file for complete search history.

(56) References Cited

U.S. PATENT DOCUMENTS 1,145,205 A * 7/1915 Mills, Jr. ..... A47B 3/12 108/101
D160,688 S * 10/1950 Brock ..... 211/128.1
D198,096 S * 4/1964 Rosenthal ..... D7/505
3,951,079 A * 4/1976 Tolleson ..... A47F 5/02 108/94
D244,971 S * 7/1977 Naumoff ..... D6/405
D250,372 S * 11/1978 Szabo ..... D6/681.3
5,598,662 A * 2/1997 Droste ..... A47G 7/041 47/39
6,550,402 B1 * 4/2003 Stone ..... A47B 7/02 108/91
D482,212 S * 11/2003 Nakaoka ..... D6/405
7,172,323 B1 * 2/2007 Knoble ..... G02B 6/001 362/555
D560,974 S * 2/2008 Goode ..... D7/500
8,240,488 B2 * 8/2012 Huang ..... B05B 13/0292 211/107
8,720,706 B2 * 5/2014 Robbins, III ..... A47F 5/04 211/133.1
8,720,708 B1 * 5/2014 Gilmore ..... A47G 7/041 108/92

(Continued)

*Primary Examiner* — Ko H Chan
(74) *Attorney, Agent, or Firm* — Heed Law Group PLCC; Thomas P. Heed

(57) ABSTRACT

A tiered fajita server, intended for use on a restaurant table, comprised of a center stack support and a plurality of serving dishes. The center stack support has a plurality of mounting cylinders, equal in number the plurality of serving dishes. Each serving dish has a mounting hole allowing it to be removably mounted on the center stack support at one, and only one mounting cylinder. quick-release mount intended for use with a rail-type fishing-rod-holder system. The center stack support is constructed from interspersed frusto-conicals and mounting cylinders. Each serving dish has a perimeter, a mounting hole, a top surface, a side surface, and a concave metal dish. The concave metal dish can be removed to ease service and cleaning.

7 Claims, 9 Drawing Sheets

(56) References Cited

U.S. PATENT DOCUMENTS

| | | | | | |
|---|---|---|---|---|---|
| D803,007 | S * | 11/2017 | Liao | ..... | D7/610 |
| 2008/0061020 | A1 * | 3/2008 | Kaisler | ..... | A47B 31/02 211/196 |

* cited by examiner

TIERED FAJITA SERVER

FIELD OF INVENTION

This invention relates to the service of heated restaurant items. Specifically, this invention relates to a tiered fajita server

BACKGROUND OF INVENTION

The present invention refines and builds upon the current state-of-the-art for restaurant service items. Specifically, the present invention is a tiered fajita server that is intended to minimize the table space required to serve a traditional fajita meal.

Currently, when fajitas are served in a restaurant, part of the meal is presented on a hot skillet while the remainder of the meal is served on one or more un-heated service item. In restaurants with small tables, or when a party orders more than one fajita meal, the available table surface space may be overwhelmed. The present invention is intended to overcome this problem by providing a tiered service item that will allow a fajita meal to be served with less overall table space.

SUMMARY OF THE INVENTION

This summary is intended to disclose the present invention, a tiered fajita server. The embodiments and descriptions are used to illustrate the invention and its utility, and are not intended to limit the invention or its use. The present invention, a tiered fajita server, is intended for use on a restaurant table, in order to serve fajitas or other food items that require several dishes. Often times, a restaurant table can be overwhelmed with multiple fajita dishes, creating a risk for spill and impairing the restaurant experience. The invention is comprised of a center stack support with a plurality of serving dishes. The serving dishes have a mounting hole, which fits over the center stack support, suspending the serving dish at a discrete, distinct locations upon the center stack support.

Each serving dish has a perimeter, a concave serving dish, a side surface, and a top surface. The concave metal dish is removable, for ease of cleaning and service. Each serving dish has a cylindrical mounting hole, with a diameter.

The center stack support has a flat bottom, a rounded apex, and a centerline. The tiered fajita server is designed to be stable about the centerline of the center stack support. The profile of the center stack support between the bottom of the center stack support and the rounded apex is comprised of a plurality of frusto-conicals interspersed with a plurality of mounting cylinders. In the preferred embodiment, there are three mounting cylinders on the center stack support, denominated the top cylinder, the middle cylinder, and the bottom cylinder. For stability, the bottom of the center stack support is weighted. Each of the plurality of cylinders, top, middle, and bottom, has a bottom edge. In one embodiment, the profile of the frusto-conical sections is discontinuous, meaning that a single straight line cannot be drawn through the profile of all of the frusto-conicals. In an alternative embodiment of the center stack support, the profile of the frusto-conical sections is continuous, meaning that a single straight line can be drawn through the profile of all of the frusto-conicals.

The tiered fajita server is designed so that a plurality of serving dishes fit on the center stack support. The serving dishes have cylindrical mounting holes that fit on the center stack support, and map, in a one-to-one fashion to the mounting cylinders of the center stack support. The size of the mounting hole dictates the discrete location on the center stack support at which a serving dish will come to rest. In the alternative embodiment, in which the profile of the frusto-conical sections is continuous, each mounting cylinder has a bottom that terminates in an orthogonal annulus. The serving dish mounting hole fits over the alternative embodiment of the center stack support and allows the serving dish to rest on an annulus of the appropriate mounting cylinder. The serving dish mounting holes map, in a one-to-one fashion with the mating cylinders of the alternative embodiment of the center stack support.

Typically, there are a plurality of mounting hole sizes. In the preferred embodiments, three different mounting hole sizes are used: small, medium, and large. In one embodiment of the invention, the plurality of serving dishes are of different sizes, denominated smallest, medium, and largest. In this embodiment, each of the three dish has a different perimeter, concave serving dish, side surface, and top surface. The smallest serving dish has the smallest perimeter and the smallest mounting hole; the largest serving dish has the largest perimeter and the largest mounting hole; and the medium serving dish has an intermediate perimeter, between the smallest perimeter on the smallest serving dish and the largest perimeter on the largest serving dish. The medium serving dish has a medium mounting hole. The largest serving dish is weighted and mates with the bottom cylinder of the center stack support. The largest serving dish has feet which sit flush on the table when in situ, along with the base of the center stack support, to provide additional stability to the tiered fajita server. The medium serving dish mates with the middle cylinder of the center stack support. The smallest serving dish mates with the top cylinder of the center stack support.

In an alternative embodiment, all of the serving dishes are the same size, except for the mounting hole. In the alternative embodiment, the three serving dishes have the same perimeter, concave serving dish, side surface and top surface, with one dish having the smallest mounting hole, one dish having a medium mounting hole, and one dish, which is weighted and has feet, having the largest mounting hole.

The largest serving dish, sitting at the bottom of the center stack support and being weighted, is denominated the base serving dish, because it provides a part of the static stability of the tiered fajita server stability, and it must be the first serving dish put in place. The serving dishes at the middle and top of the center stack can pivot about the centerline of the center stack support. In this way, the present invention frees up space on the restaurant table.

The center stack support can be fabricated from any structural material, such as aluminum, steel, magnesium, or suitable engineered plastics. Suitable engineered plastics include, but are not limited to, acrylic, acrylonitrile butadiene styrene ("ABS"), and polycarbonate. The concave metal dishes are made from steel. The serving dishes can be made from structural material such as aluminum, steel, magnesium, or suitable high-temperature engineered plastics. Suitable high-temperature engineered plastics include polyetherimide ("PEI"), polyetheretherketone ("PEEK"), and polyphenylsulfone ("PPSU").

BRIEF DESCRIPTION OF THE DRAWINGS

The present invention is illustrated with 8 drawings on 9 sheets.

DETAILED DESCRIPTION OF THE DRAWINGS

The following descriptions are not meant to limit the invention, but rather to add to the summary of invention, and illustrate the present invention, a tiered fajita server. The present invention is illustrated with a variety of drawings showing various possible embodiments.

Figure 7:
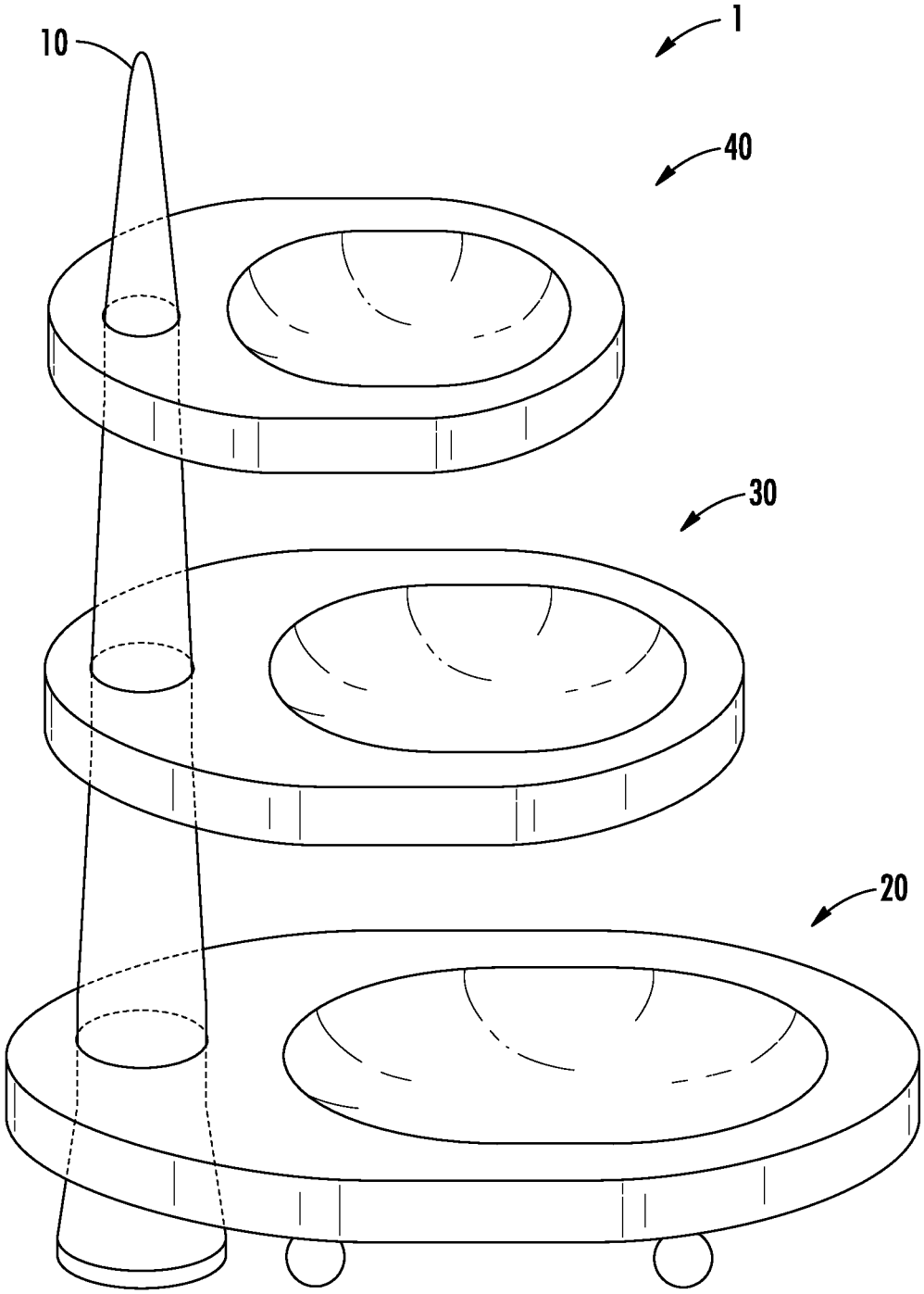
FIG. 7 is a perspective view of the present invention, a tiered fajita server.
Figure 8:
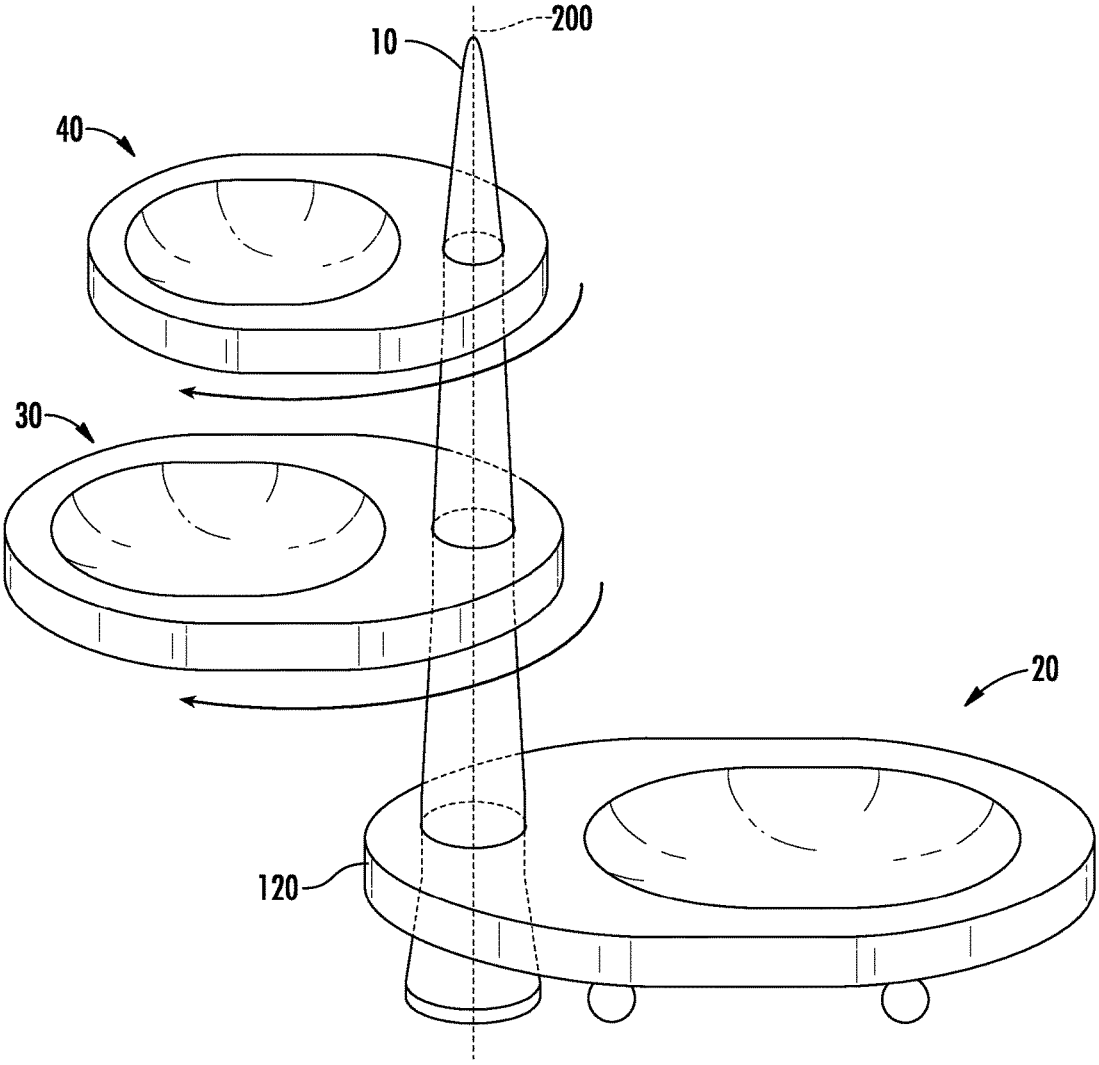
FIG. 8 is a perspective view of the present invention, showing in situ use of the present invention.

FIG. 7 shows the present invention 1, a tiered fajita server 1. The present invention 1 is intended for use on a restaurant table, in order to serve fajitas or other food items that require several dishes. Often times, a restaurant table can be overwhelmed with multiple fajita dishes, creating a risk for spill and impairing the restaurant experience. The invention is comprised of a center stack support 10, with a plurality of serving dishes 20, 30, 40. The bottom serving dish 20 is a base serving dish 20, which is weighted to provide the tiered fajita server 1 stability. FIG. 8 shows the tiered fajita server 1, in situ. The upper serving dishes 30, 40 can pivot about the centerline 200 of the center stack support 10. The base serving dish 20, which is the largest serving dish 20, has a side surface 120 and is weighted to provide the invention stability. When the present invention 1 is placed on a flat surface, the center stack support 10 is orthogonal to the flat surface and the serving dishes 20, 30, 40 are parallel to the flat surface. In this way, the present invention 1 frees up space on the restaurant table.

Figure 1A:
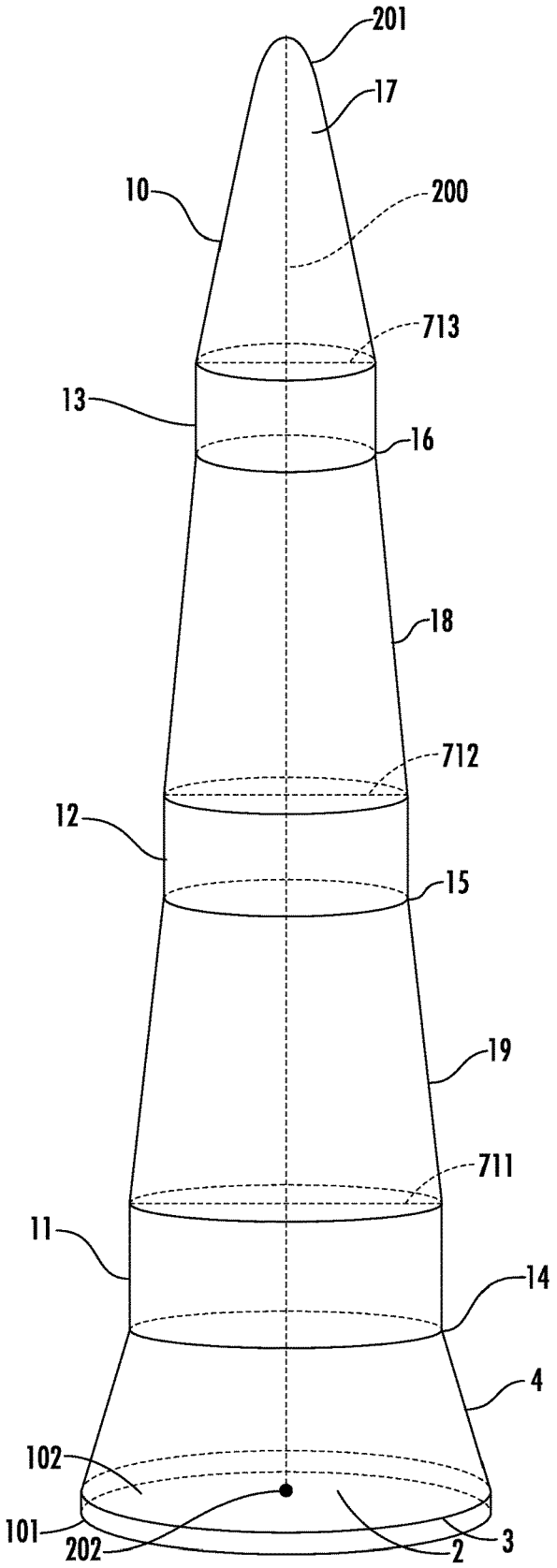
FIG. 1A is a perspective view of a center stack support.

FIG. 1A is a perspective view of the center stack support 10. The center stack support 10 has a flat bottom 102, a rounded apex 201, and a centerline 200. When placed on a flat surface, the centerline 200 is orthogonal to the flat surface. The profile of the center stack support 10, between the bottom 102 and the rounded apex 201, is comprised of a plurality of frusto-conicals 4, 19, 18, 17 and a plurality of cylinders 13, 12, 11. The upper frusto-conical 17 transitions into the rounded apex 201. The cylinders 13, 12, 11 are denominated as the top cylinder 13, the middle cylinder 12, and the bottom cylinder 11. Each cylinder 13, 12, 11 has a corresponding diameter 713, 712, 711. The diameter 713 of the top cylinder 13 is smaller than the diameter 712 of the middle cylinder 12. The diameter 712 of the middle cylinder 12 is smaller than the diameter 711 of the bottom cylinder 11. The profile of the frusto-conical sections 4, 19, 18, 17 is discontinuous, meaning that a single straight line cannot be drawn through the profile of all of the frusto-conicals 4, 19, 18, 17. Each of the plurality of cylinders 13, 12, 11 has a bottom edge 16, 15, 14. The bottom of the center stack support 10 is a cylinder that is defined by two circles 3, 101. The volume 2 defined between the two circles 3, 101 is weighted, in order to provide stability to the center stack support 10. The bottom frusto-conical 4 can also be weighted, in order to provide additional stability to the center stack support 10. The centerline 200 terminates in the middle 202 of the bottom circle 101.

Figure 1B:
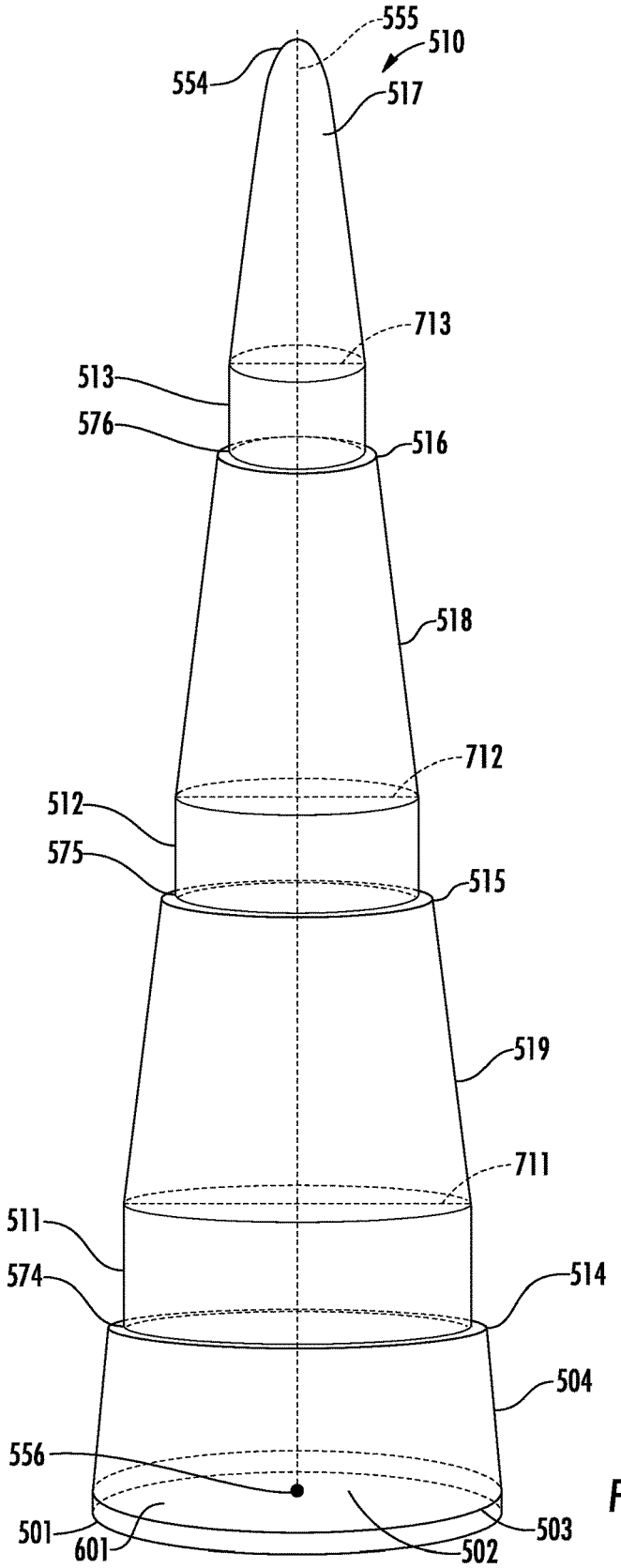
FIG. 1B is a perspective view of an alternative embodiment of the center stack support.

FIG. 1B is a perspective view of an alternative embodiment of the center stack support 510. The center stack support 510 has a flat bottom 502, a rounded apex 554, and a centerline 555. When placed on a flat surface, the centerline 555 is orthogonal to the flat surface. The profile of the center stack support 510, between the bottom 502 and the rounded apex 554, is comprised of a plurality of frusto-conicals 504, 519, 518, 517 and a plurality of cylinders 513, 512, 511. The upper frusto-conical 517 transitions into the rounded apex 554. The cylinders 513, 512, 511 are denominated as the top cylinder 513, the middle cylinder 512, and the bottom cylinder 511. Each cylinder 513, 512, 511 has a corresponding diameter 713, 712, 711. The diameter 713 of the top cylinder 513 is smaller than the diameter 712 of the middle cylinder 512. The diameter 712 of the middle cylinder 512 is smaller than the diameter 711 of the bottom cylinder 511. The cylinder diameters 713, 712, 711 are identical for both center stack supports 10, 510. In this embodiment, the profile of the frusto-conical sections 504, 519, 518, 517 is continuous, meaning that a single straight line can be drawn through the profile of all of the frusto-conicals 504, 519, 518, 517. Such a straight line is not shown, but the continuous profile is apparent in the drawing. Each of the plurality of cylinders 513, 512, 511 has a bottom edge 576, 575, 574. There is an annulus 516, 515, 514, at each of the bottom edge 576, 575, 574 of the plurality of cylinders 513, 512, 511. The annulus 516, 515, 514 are orthogonal to the cylinder 513, 512, 511 at the bottom edge 576, 575, 574 of the cylinder 513, 512, 511. The bottom of the center stack support 510 is a cylinder that is defined by two circles 503, 501. The volume 502 defined between the two circles 503, 501 is weighted, in order to provide stability to the center stack support 510. The bottom frusto-conical 504 can also be weighted, in order to provide additional stability to the center stack support 510. The centerline 555 terminates in the middle 556 of the bottom circle 501.

Figure 2A:
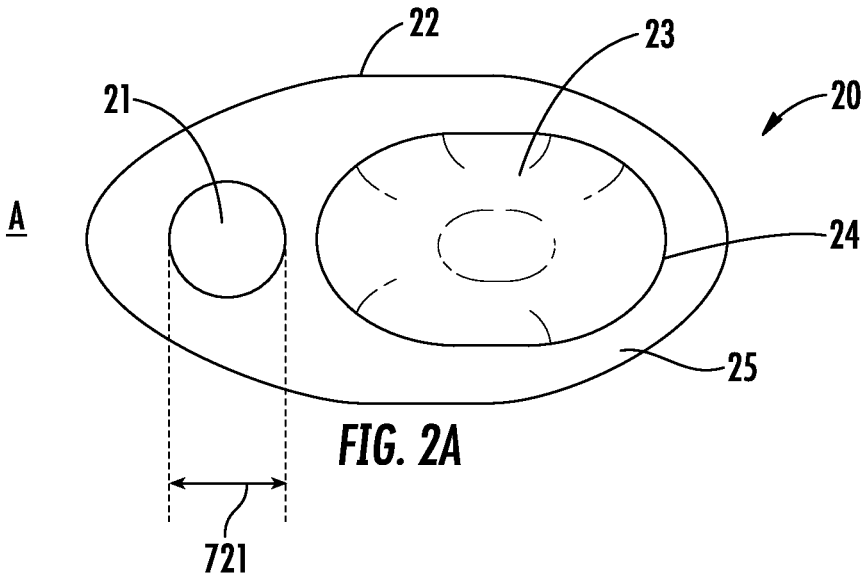
FIGS. 2A, 2B, and 2C are top views of serving dishes of various sizes.
Figure 2B:
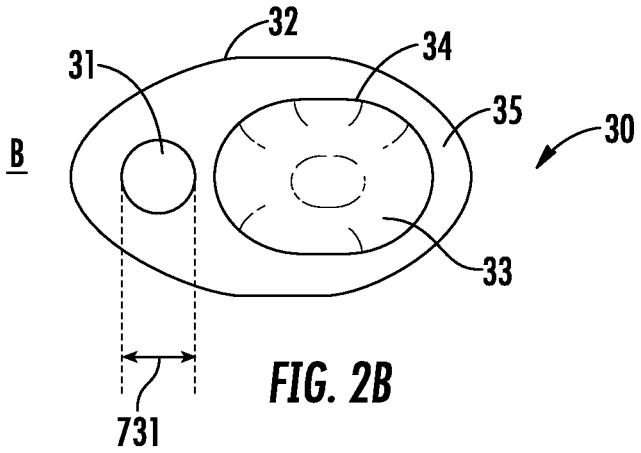
Figure 2C:
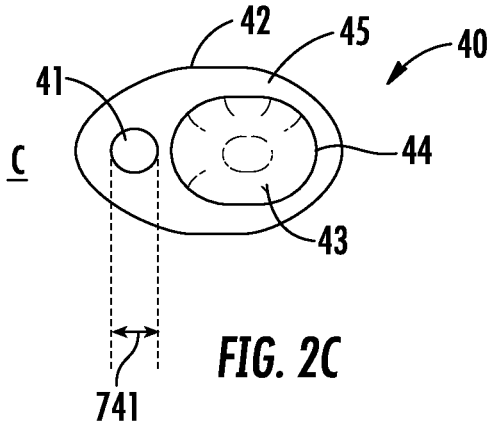

The tiered fajita server 1 is designed so that a plurality of serving dishes 20, 30, 40 fit on the center stack support 10, 510. FIGS. 2A, 2B, and 2C shows a plurality of serving dishes of various sizes. FIG. 2A shows the largest serving dish 20; FIG. 2B shows a medium serving dish 30; and FIG. 2C shows a small serving dish 40.

Figure 4:
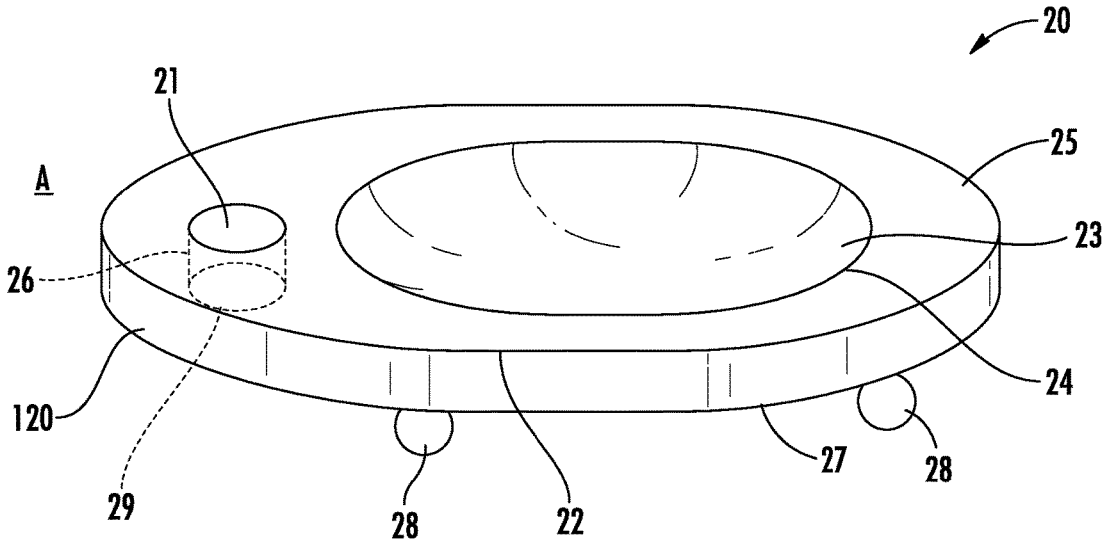
FIG. 4 is a perspective view of a base serving dish.
Figure 5A:
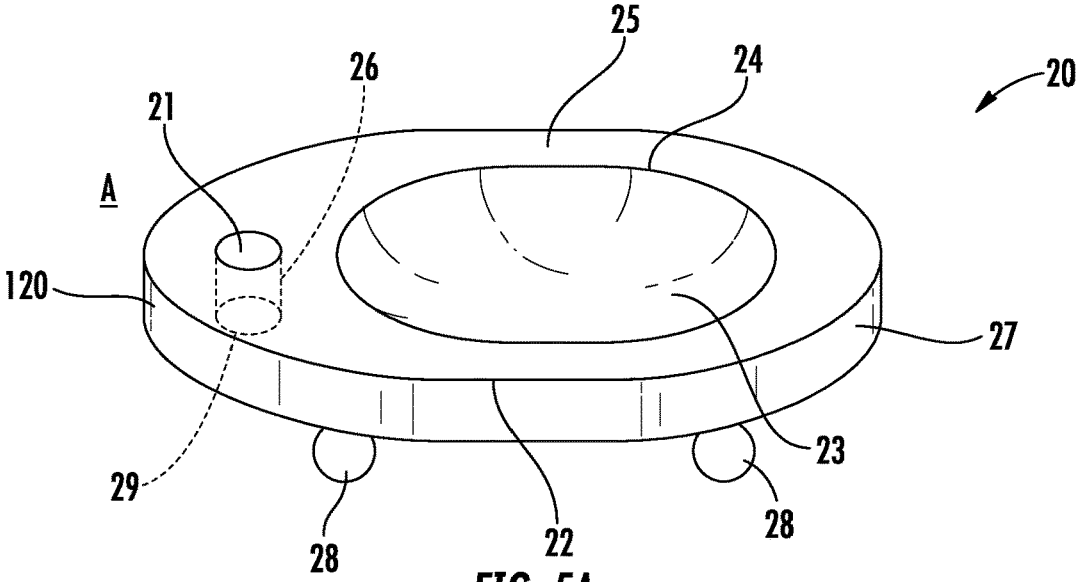
FIGS. 5A, 5B, and 5C are perspective views of serving dishes of various sizes.

In FIG. 2A, the largest serving dish 20 has a perimeter 22, a concave metal dish 23 with a rim 24, and a top surface 25. The largest serving dish 20 has a mounting hole 21. The mounting hole 21 has a diameter 721 that mates with lowest cylinder 11, 511 on the center stack support 10, 510, so that the largest serving dish 20 is stopped at the bottom edge 14, 574 of the bottom cylinder 11, 511. In the alternative embodiment of the center stack support 510, the largest dish 20 rests on the bottom annulus 514. The largest serving dish 20 is weighted so that it provides stability to the tiered fajita server 1. FIGS. 4 and 5A show perspective views of the largest serving dish 20. FIG. 4 is the largest serving dish 20 in isolation. FIG. 5A is the largest serving dish 20 in comparison with the other serving dishes 30, 40.

In FIGS. 4 and 5A, the perimeter 22, concave metal dish 23 with rim 24, top surface 25, and mounting hole 21 are all visible. The concave metal dish 23 is removable for ease of cleaning and serving. The mounting hole 21 is a cylinder defined by an upper opening or circle 21, a lower circle or opening 29, and a side surface 26. The mounting hole 21 goes through the large serving dish 20. The large serving dish 20 has a lower edge 27, a side surface 120, and feet 28. The feet 28 are designed to side on the table.

In FIG. 2B, the medium serving dish 30 has a perimeter 32, a concave metal dish 33 with a rim 34, and a top surface 35. The medium serving dish 30 has a mounting hole 31. The mounting hole 31 has a diameter 731 that mates with middle cylinder 12, 512 on the center stack support 10, 510, so that the medium serving dish 30 is stopped at the bottom edge 15, 575 of the middle cylinder 12, 512. In the alternative embodiment of the center stack support 510, the medium dish 30 rests on the middle annulus 515.

Figure 5B:
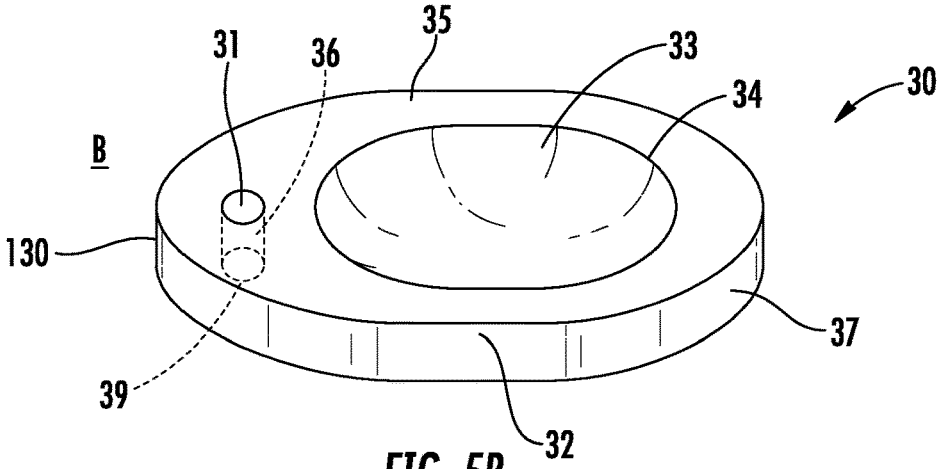

FIG. 5B is a perspective view of the medium serving dish 30. FIG. 5B shows the medium serving dish 30 in comparison with the other serving dishes 20, 40. In FIG. 5B, the perimeter 32, concave metal dish 33 with rim 34, top surface 35, and mounting hole 31 are all visible. The concave metal dish 33 can be removed for ease of cleaning and serving. The mounting hole 31 is a cylinder defined by an upper opening or circle 31, a lower circle or opening 39, and a side surface 36. The mounting hole 31 goes through the medium serving dish 30. The medium serving dish 30 has a lower edge 37, and a side surface 130. The medium serving dish 30 is larger than the small serving dish 40. The medium serving dish 30 is smaller than the large serving dish 20.

In FIG. 2C, the small serving dish 40 has a perimeter 42, a concave metal dish 43 with a rim 44, and a top surface 45. The small serving dish 40 has a mounting hole 41. The mounting hole 41 has a diameter 741 that mates with top cylinder 13, 513 on the center stack support 10, 510, so that the small serving dish 40 is stopped at the bottom edge 16, 576 of the top cylinder 13, 513. In the alternative embodiment of the center stack support 510, the small dish 20 rests on the middle annulus 516.

Figure 5C:
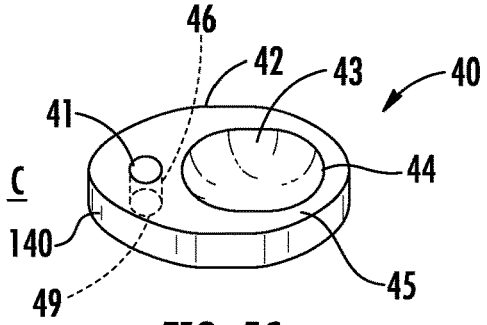

FIG. 5C is a perspective view of the small serving dish 40. FIG. 5C shows the small serving dish 40 in comparison with the other serving dishes 20, 30. In FIG. 5C, the perimeter 42, concave metal dish 43 with rim 44, top surface 45, and mounting hole 41 are all visible. The concave metal dish 43 can be removed for ease of cleaning and serving. The mounting hole 41 is a cylinder defined by an upper opening or circle 41, a lower circle or opening 49, and a side surface 46. The mounting hole 41 goes through the small serving dish 40. The small serving dish 40 has a lower edge 47, and a side surface 140. The small serving dish 40 is smaller than both the medium serving dish 30 and the large serving dish 20.

Figure 3A:
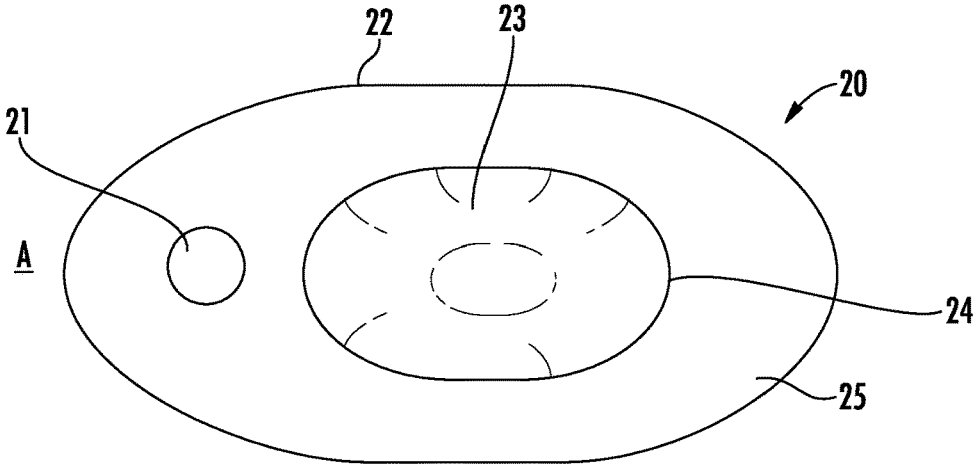
FIGS. 3A, 3B, and 3C are top views of an alternative embodiment of serving dishes, in which all of the serving dishes are similarly sized.
Figure 3B:
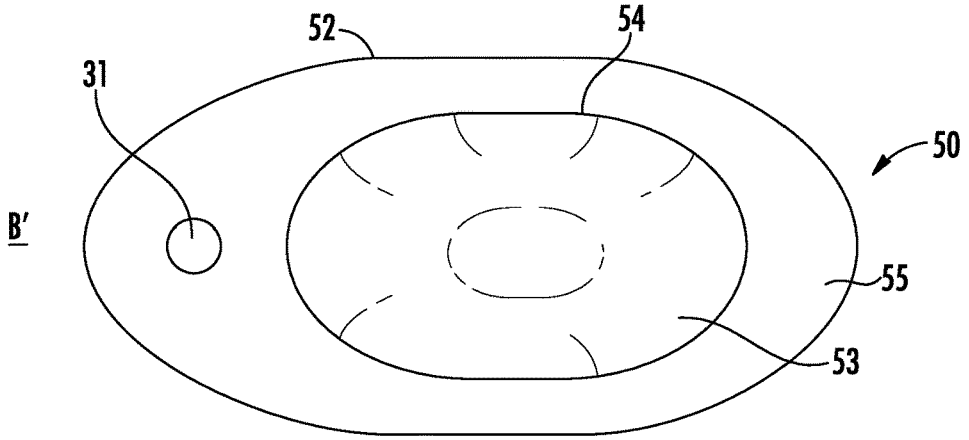
Figure 3C:
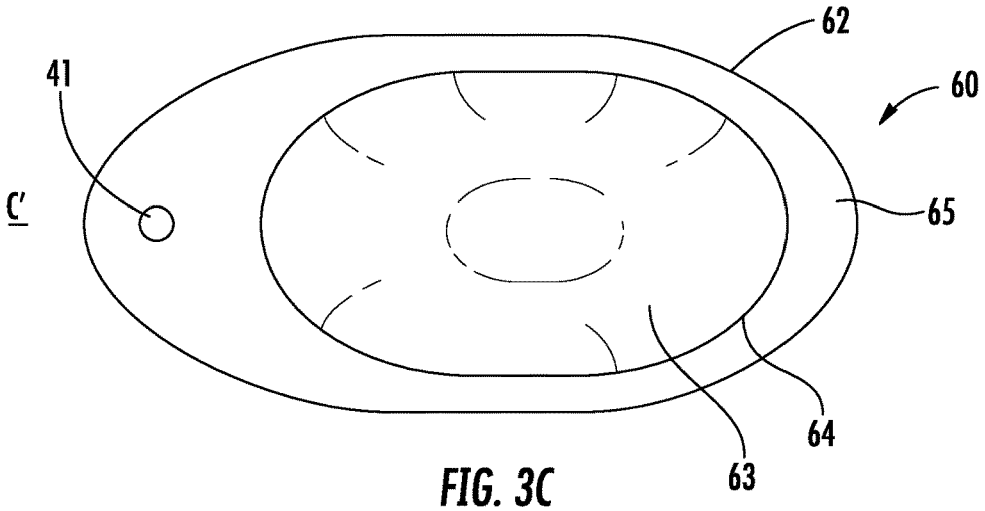
Figure 6A:
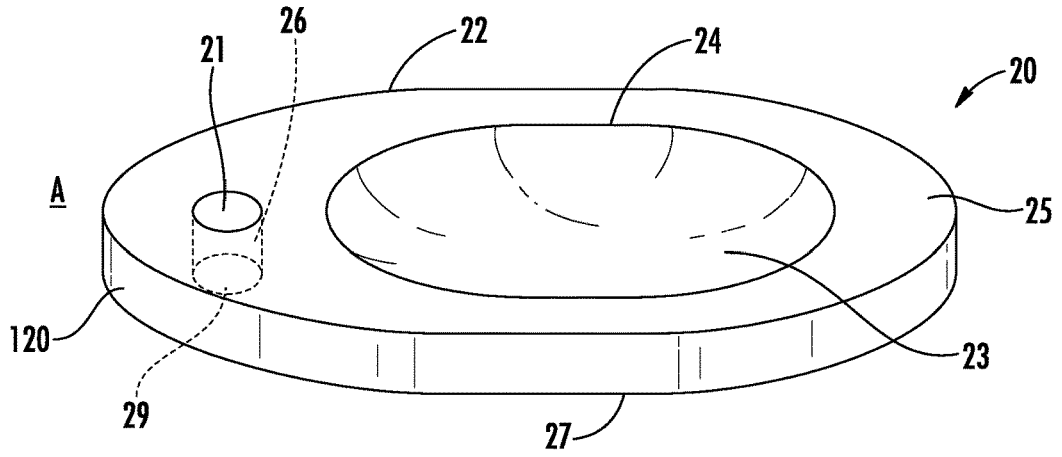
FIGS. 6A, 6B, and 6C are perspective views of serving dishes of an alternative embodiment of serving dishes, in which all of the serving dishes are similarly sized.
Figure 6B:
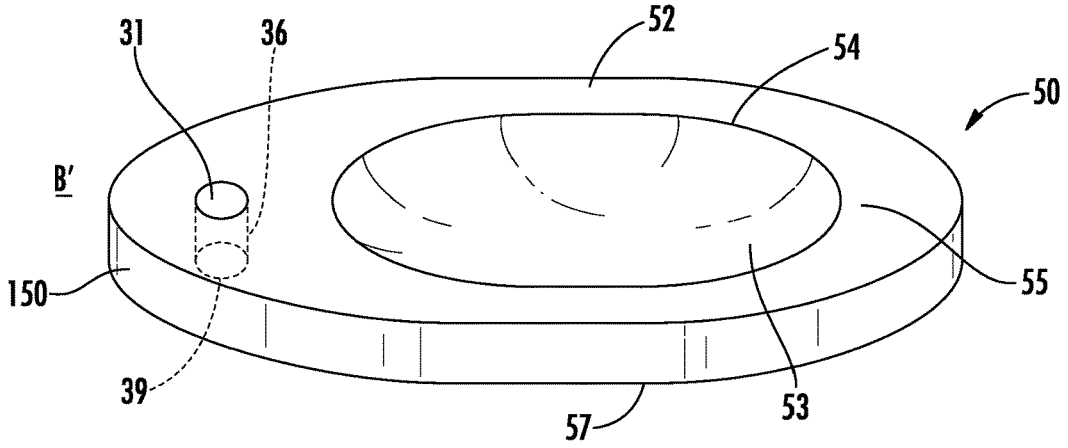
Figure 6C:
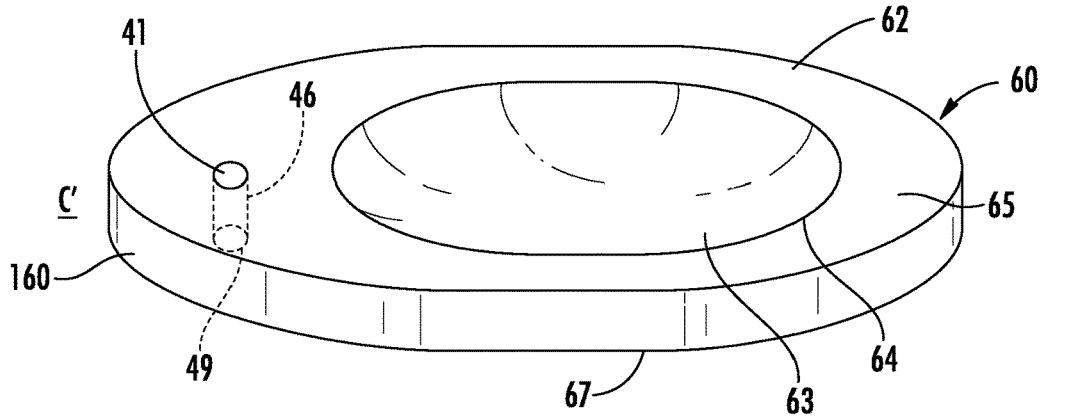

FIGS. 3A, 3B, 3C, 6A, 6B, and 6C show an alternative embodiment of serving dishes 20, 50, 60, in comparison to one another. The alternative embodiment serving dishes 20, 50, 60 are identical, except for the mounting holes 21, 31, 41. FIGS. 3A and 6A show a large serving dish 20, which is identical to that shown in FIGS. 2A, 4, and 5A. The large serving dish 20 has a mounting hole 21 which mates with the bottom mounting cylinder 11, 511. FIGS. 3B and 6B show a large serving dish 50 with a mounting hole 31 that mates with the bottom cylinder 12, 512 on the center stack support 10, 510, so that the serving dish 50 is stopped at the bottom edge 15, 575 of the middle cylinder 12, 512. In the alternative embodiment of the center stack support 510, the serving dish 50 rests on the middle annulus 515. FIGS. 3C and 6C show a large serving dish 60 with a mounting hole 41 that mates with the top cylinder 13, 513 on the center stack support 10, 510, so that the serving dish 60 is stopped at the bottom edge 16, 576 of the top cylinder 13, 513. In the alternative embodiment of the center stack support 510, the serving dish 60 rests on the top annulus 516.

FIGS. 3A, 3B, and 3C show three equal sized serving dishes 20, 50, 60. The three serving dishes 20, 50, 60 have identical perimeters 22, 52, 62. The three serving dishes 20, 50, 60 use identical concave metal dishes 23, 53, 63 with identical rims 24, 54, 64. The three serving dishes 20, 50, 60 have identical top surfaces 25, 55, 65. FIGS. 6A, 6B, and 6C show a perspective view of the alternative embodiment of equal sized serving dishes 20, 50, 60. The three serving dishes 20, 50, 60 have identical lower edges 27, 57, 67 and a side surfaces 120, 150, 160.

The three serving dishes 20, 50, 60 have different mounting holes 21, 31, 41. The mounting holes 21, 31, 41 have an upper hole or opening 21, 31, 41, a lower hole or opening 29, 39, 49, and an inner surface 26, 36, 46. Hole 21 is larger than hole 31, which is larger than hole 41. The smallest hole 41 is intended to mate with the top cylinder 13, 513. The medium hole 31 is intended to mate with the middle cylinder 12, 512. The largest hole 21 is intended to mate with the bottom cylinder 11, 511.

The mating holes 21, 31, 41 have defined inner diameters 721, 731, and 741 (shown in FIGS. 2A, 2B, and 2C). The top mounting cylinder 13, 513 has an outer diameter 713 which is slightly smaller than the inner diameter 741 of the smallest mounting hole 41. This allows the small mounting hole 41 to mate with the top mounting cylinder 13, 513. The middle mounting cylinder 12, 512 has an outer diameter 712, which is slightly smaller than the inner diameter 731 of the medium mounting hole 31. This allows the medium mounting hole 31 to mate with the middle mounting cylinder 12, 512. The bottom mounting cylinder 11, 511 has an outer diameter 711 which is slightly smaller than the inner diameter 721 of the largest mounting hole 21. This allows the largest mounting hole 21 to mate with the bottom mounting cylinder 11, 511. When the present invention 1 is placed on a flat surface, the center stack support 10, 510 centerline 200, 555 is orthogonal to the flat surface (not shown). When removably mounted on the center stack support 10, 510, the serving dishes 20, 30, 40, 50, 60 are orthogonal to the center stack support 10, 510 centerline 200, 555 and parallel to the flat surface (not shown).

The center stack support 10, 510 can be fabricated from any structural material, such as aluminum, steel, magnesium, or suitable engineered plastics. The center stack support 10, 510 can be fabricated from perforated metal (perforations are not shown in the drawings). Suitable engineered plastics include, but are not limited to, acrylic, acrylonitrile butadiene styrene ("ABS"), and polycarbonate. The concave metal dishes 23, 33, 43, 53, 63 are made from steel. The serving dishes 20, 30, 40, 50, 60 can be made from structural material such as aluminum, steel, magnesium, or suitable high-temperature engineered plastics. Suitable high-temperature engineered plastics include polyetherimide ("PEI"), polyetheretherketone ("PEEK"), and polyphenylsulfone ("PPSU").

We claim:

1. A tiered fajita server apparatus comprising a center stack support, having a centerline, with an apex on top, a base on the bottom, and a plurality of frusto-conicals interspersed with a plurality of mounting cylinders in between the apex and the base, the plurality of frusto-conicals and the plurality of mounting cylinders comprising a surface with a profile;

a plurality of serving dishes, equal in number to the plurality of mounting cylinders, with each serving dish having a top surface, a side surface, a perimeter, a concave metal dish, and a mounting hole;

wherein each mounting cylinder has a distinct outer diameter, and the outer diameters of the mounting cylinders increase in size from the apex to the base;

wherein the mounting hole of each serving dish has a distinct inner diameter;

wherein the mounting hole inner diameters map, in a one-to-one fashion, with the mounting cylinder outer diameters;

wherein a mounting hole inner diameter will allow its serving dish to be removably mounted to the center stack support at its mapped mounting cylinder;

wherein, when placed on a flat surface, the center stack support centerline is orthogonal to the flat surface;

wherein the serving dishes, when removably mounted to the center stack support, are parallel to the flat surface and are orthogonal to the centerline; and wherein a weighted serving dish, called a base serving dish, has feet, and the feet of the base serving dish and the base on the bottom of the center stack support both rest on the flat surface.

2. The tiered fajita server apparatus of claim 1, wherein the profile of the center stack support is discontinuous, meaning that a single straight line cannot be drawn across all of the frusto-conical surfaces.

3. The tiered fajita server apparatus of claim 1, wherein the profile of the center stack support is continuous, meaning that a single straight line can be drawn across all of the frusto-conical surfaces.

4. The tiered fajita server apparatus in claim 1, wherein the plurality of serving dishes is equal to three and the plurality of mounting cylinders is equal to three.

5. The tiered fajita server apparatus in claim 4, where all of the plurality of serving dishes have the same perimeter.

6. The tiered fajita server apparatus of claim 4, wherein all of the plurality of serving dishes have different perimeters.

7. The tiered fajita server apparatus of claim 6, wherein the mounting cylinder with the smallest outer diameter is denominated as the smallest mounting cylinder; the mounting cylinder with the largest outer diameter is denominated as the largest mounting cylinder; and the third mounting cylinder is denominated as the middle mounting cylinder;

wherein the mounting hole that maps to the smallest mounting cylinder is the smallest mounting hole; the mounting hole that maps to the middle mounting cylinder is the medium mounting hole; and the mounting hole that maps to the largest mounting cylinder is the largest mounting hole; and wherein the serving dish with the smallest perimeter has the smallest mounting hole, the serving dish with the largest perimeter has the largest mounting hole, and the remaining serving dish has the medium mounting hole.

* * * * *